US010822900B2

(12) United States Patent
Brasseaux et al.

(10) Patent No.: US 10,822,900 B2
(45) Date of Patent: Nov. 3, 2020

(54) POSITIONING TOOL WITH EXTENDABLE LANDING DOGS

(71) Applicant: WEATHERFORD TECHNOLOGY HOLDINGS, LLC, Houston, TX (US)

(72) Inventors: Jason J. Brasseaux, Cypress, TX (US); Brian J. Ritchey, Hockley, TX (US); Joshua M. Hornsby, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 380 days.

(21) Appl. No.: 15/012,623

(22) Filed: Feb. 1, 2016

(65) Prior Publication Data

US 2017/0218712 A1 Aug. 3, 2017

(51) Int. Cl.
*E21B 23/03* (2006.01)
*E21B 43/04* (2006.01)

(52) U.S. Cl.
CPC ..... *E21B 23/03* (2013.01); *E21B 43/045* (2013.01)

(58) Field of Classification Search
CPC .. E21B 2034/007; E21B 21/103; E21B 33/12; E21B 33/127; E21B 33/129; E21B 34/06; E21B 43/08
See application file for complete search history.

(56) References Cited

U.S. PATENT DOCUMENTS 4,043,392 A 8/1977 Gazda
4,232,889 A * 11/1980 Putch ..... E21B 23/02 166/217
4,273,190 A 6/1981 Baker et al.
4,508,167 A * 4/1985 Weinberg ..... E21B 17/06 166/120
4,871,018 A * 10/1989 Caskey ..... E21B 23/02 166/142

(Continued)

FOREIGN PATENT DOCUMENTS

WO 2016/108886 7/2016

OTHER PUBLICATIONS

Combined Search and Examination Report dated Jun. 1, 2017 for UK Patent Application No. GB1701641.1, 5 pages.

(Continued)

*Primary Examiner* — James G Sayre
(74) *Attorney, Agent, or Firm* — Smith IP Services, P.C.

(57) ABSTRACT

A positioning tool can include a mandrel and an engagement device reciprocably disposed on the mandrel. The engagement device can include at least one engagement member and at least one landing dog. The mandrel can displace relative to the engagement device in response to engagement between the engagement member and at least one internal profile in an outer tubular string, and the landing dog can extend outward in response to displacement of the mandrel in a selected longitudinal direction relative to the engagement device. A system for use in a well can include a tubular string and a positioning tool reciprocably disposed in the tubular string. The positioning tool can include a landing dog that extends outward from a retracted position to engage one or more internal profiles of the tubular string, in response to a pattern of reciprocation of the positioning tool in the tubular string.

19 Claims, 9 Drawing Sheets

(56) References Cited

U.S. PATENT DOCUMENTS 5,320,183 A * 6/1994 Muller ..... E21B 23/006 166/120
5,390,735 A * 2/1995 Williamson, Jr. ..... E21B 23/02 166/115
5,615,740 A * 4/1997 Comeau ..... E21B 7/061 166/117.5
6,510,898 B1 1/2003 Buytaert
2001/0013410 A1* 8/2001 Beck ..... E21B 31/18 166/65.1
2011/0042107 A1* 2/2011 Chambers ..... E21B 34/14 166/386
2014/0246246 A1* 9/2014 Radford ..... E21B 34/14 175/270
2014/0251628 A1* 9/2014 Wilkin ..... E21B 34/14 166/318
2015/0152711 A1* 6/2015 Foong ..... E21B 34/14 166/373
2015/0345256 A1* 12/2015 Tulloch ..... E21B 10/00 166/381
2015/0376982 A1* 12/2015 Renkes ..... E21B 34/102 166/373
2016/0102526 A1* 4/2016 Wind ..... E21B 33/146 166/289

OTHER PUBLICATIONS

Specification and Drawings for U.S. Appl. No. 14/992,638, filed Jan. 11, 2015, 37 pages.
FASTool; "Model A SMART Collet (System Multi-Acting Repositioning Tool)" Product Family No. H44591, product brochure, p. 70 of Service Tools, received Jan. 12, 2016, 1 page.
Halliburton; "Reverse Position Indicators", company brochure, Downhole Sand Components (3-43-3-44), received Jan. 12, 2016, 1 page.
Australian Examination Report dated Mar. 27, 2018 for AU Patent Application No. 2017200623, 5 pages.
Australian Office Action dated Jan. 30, 2019 for AU Patent Application No. 2017200623, 4 pages.

* cited by examiner

POSITIONING TOOL WITH EXTENDABLE LANDING DOGS

BACKGROUND

This disclosure relates generally to equipment and operations utilized in conjunction with subterranean wells and, in an example described below, more particularly provides a positioning tool and associated systems and methods.

Although variations are possible, a gravel pack is generally an accumulation of "gravel" (typically sand, proppant or another granular or particulate material, whether naturally occurring or synthetic) about a tubular filter or screen in a wellbore. The gravel is sized, so that it will not pass through the screen, and so that sand, debris and fines from an earth formation penetrated by the wellbore will not easily pass through the gravel pack with fluid flowing from the formation. Although relatively uncommon, a gravel pack may also be used in an injection well, for example, to support an unconsolidated formation.

Placing the gravel about the screen in the wellbore is a complicated process, requiring relatively sophisticated equipment and techniques to maintain well integrity while ensuring the gravel is properly placed in a manner that provides for subsequent efficient and trouble-free operation. It will, therefore, be readily appreciated that improvements are continually needed in the arts of designing and utilizing gravel pack equipment and methods.

Such improved equipment and methods may be useful with any type of gravel pack in cased or open wellbores, and in vertical, horizontal or deviated well sections. The improved equipment and methods may also be useful in well operations other than gravel packing (such as, injection operations, stimulation operations, drilling operations, etc.).

DETAILED DESCRIPTION

Figure 1:
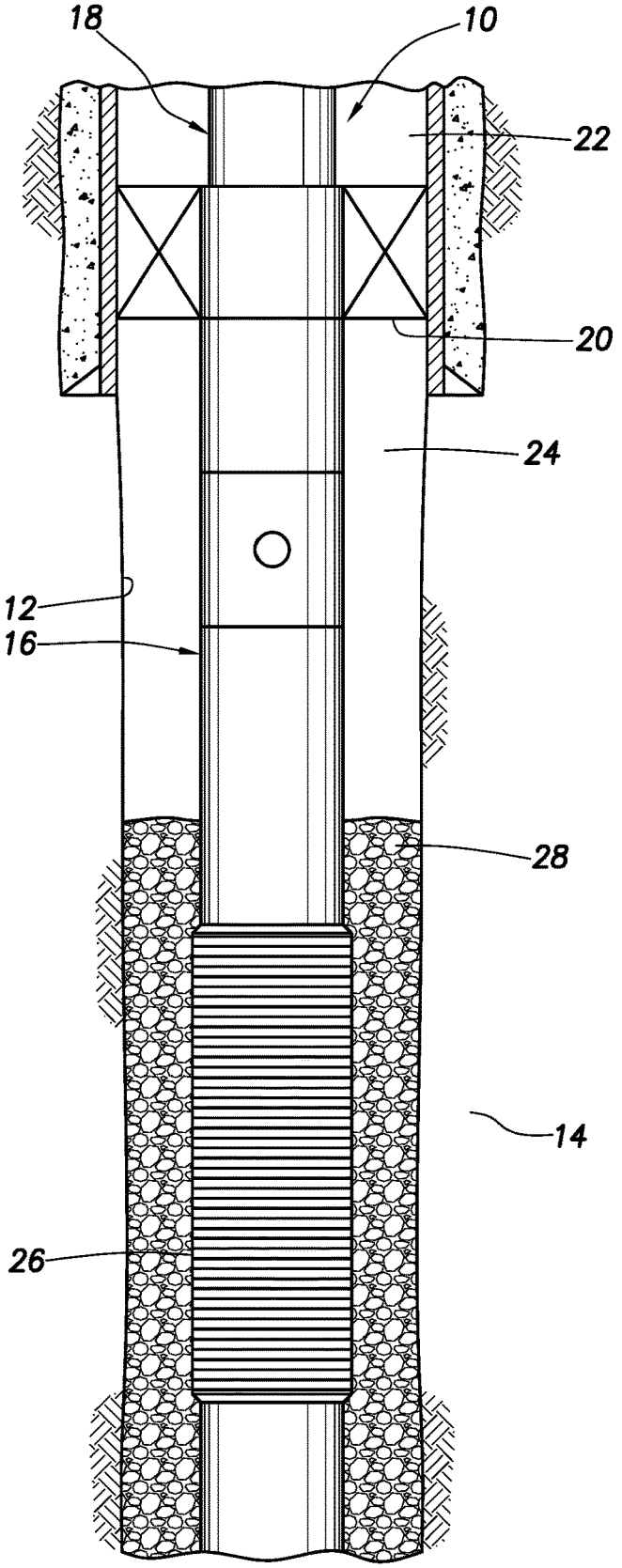
FIG. 1 is a representative partially cross-sectional view of an example of a gravel pack system and associated method which can embody principles of this disclosure.

Representatively illustrated in FIG. 1 is a gravel pack system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that it penetrates an earth formation 14. A well completion assembly 16 is installed in the wellbore 12, for example, using a generally tubular service string 18 to convey the completion assembly and set a packer 20 of the completion assembly.

Setting the packer 20 in the wellbore 12 provides for isolation of an upper well annulus 22 from a lower well annulus 24 (although, as described above, at the time the packer is set, the upper annulus and lower annulus may be in communication with each other). The upper annulus 22 is formed radially between the service string 18 and the wellbore 12, and the lower annulus 24 is formed radially between the completion assembly 16 and the wellbore.

The terms "upper" and "lower" are used herein for convenience in describing the relative orientations of the annulus 22 and annulus 24 as they are depicted in FIG. 1. In other examples, the wellbore 12 could be horizontal (in which case neither of the annuli would be above or below the other) or otherwise deviated. Thus, the scope of this disclosure is not limited to any relative orientations of examples as described herein.

As depicted in FIG. 1, the packer 20 is set in a cased portion of the wellbore 12, and a generally tubular well screen 26 of the completion assembly 16 is positioned in an uncased or open hole portion of the wellbore. However, in other examples, the packer 20 could be set in an open hole portion of the wellbore 12, and/or the screen 26 could be positioned in a cased portion of the wellbore. Thus, it will be appreciated that the scope of this disclosure is not limited to any particular details of the system 10 as depicted in FIG. 1, or as described herein.

In the FIG. 1 method, the service string 18 not only facilitates setting of the packer 20, but also provides a variety of flow passages for directing fluids to flow into and out of the completion assembly 16, the upper annulus 22 and the lower annulus 24. One reason for this flow directing function of the service string 18 is to deposit gravel 28 in the lower annulus 24 about the well screen 26.

Examples of some steps of the method are representatively depicted in FIGS. 2-7 and are described more fully below. However, it should be clearly understood that it is not necessary for all of the steps depicted in FIGS. 2-7 to be performed, and additional or other steps may be performed, in keeping with the principles of this disclosure.

Figure 2:
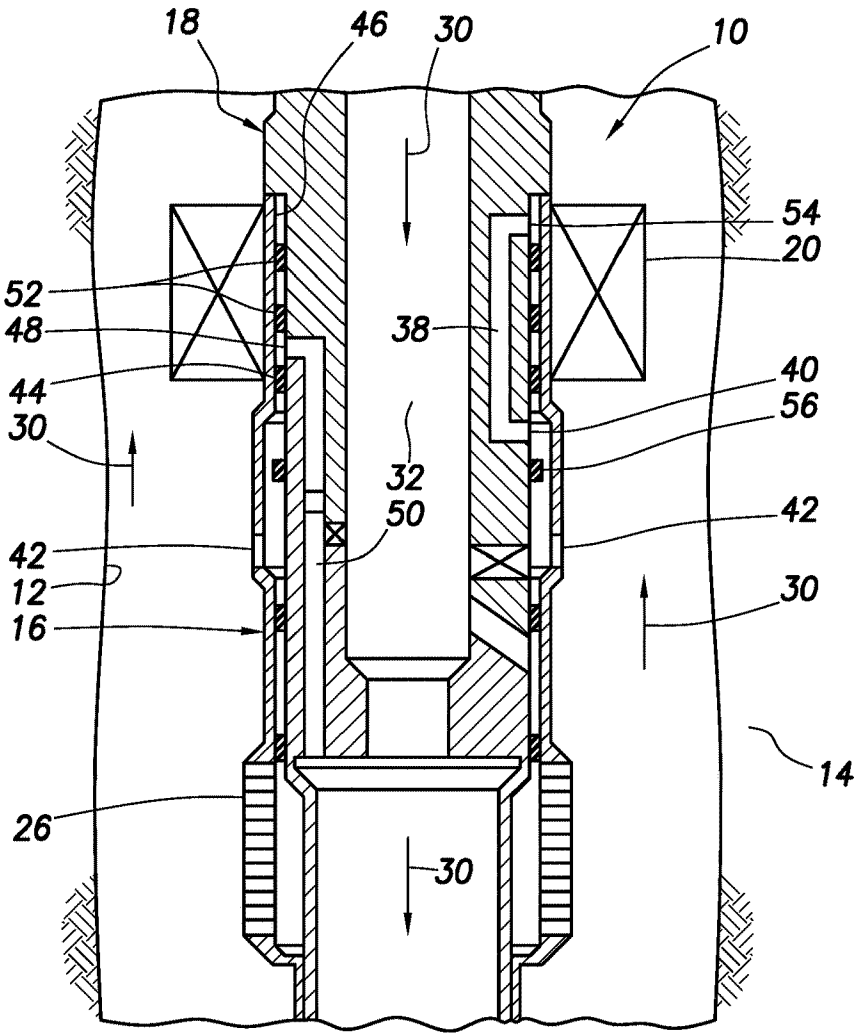

Referring now to FIG. 2, the system 10 is depicted as the service string 18 is being used to convey and position the completion assembly 16 in the wellbore 12. For clarity of illustration, the cased portion of the wellbore 12 is not depicted in FIGS. 2-7.

Note that, as shown in FIG. 2, the packer 20 is not yet set, and so the completion assembly 16 can be displaced through the wellbore 12 to any desired location. As the completion assembly 16 is displaced into the wellbore 12 and positioned therein, a fluid 30 can be circulated through a flow passage 32 that extends longitudinally through the service string 18.

Figure 3:
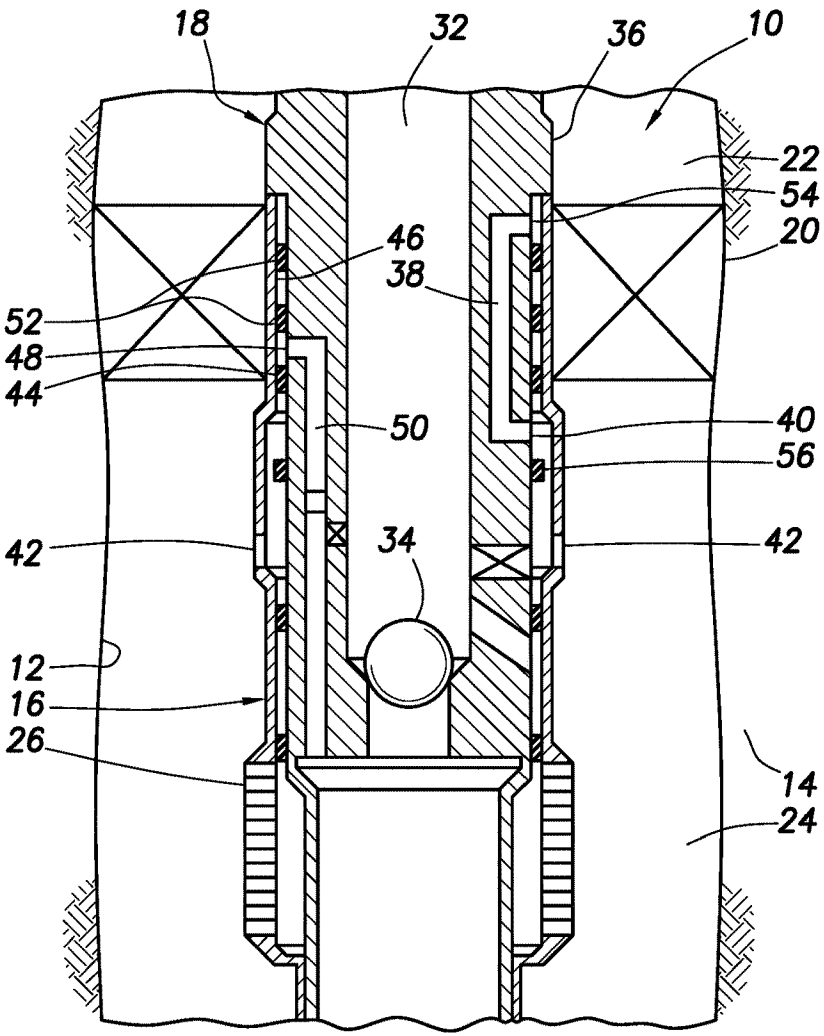
FIGS. 2-7 are representative cross-sectional views of a succession of steps in the method of gravel packing.

As depicted in FIG. 3, the completion assembly 16 has been appropriately positioned in the wellbore 12, and the packer 20 has been set to thereby provide for isolation between the upper annulus 22 and the lower annulus 24. In this example, to accomplish setting of the packer 20, a ball, dart or other plug 34 is deposited in the flow passage 32 and, after the plug 34 seals off the flow passage, pressure in the flow passage above the plug is increased.

This increased pressure operates a packer setting tool 36 of the service string 18. The setting tool 36 can be of the type well known to those skilled in the art, and so further details of the setting tool and its operation are not illustrated in the drawings or described herein.

Although the packer 20 in this example is set by application of increased pressure to the setting tool 36 of the service string 18, in other examples the packer may be set using other techniques. For example, the packer 20 could be set by manipulation of the service string 18 (e.g., rotating in a selected direction and then setting down or pulling up, etc.), with or without application of increased pressure. Thus, the scope of this disclosure is not limited to any particular technique for setting the packer 20.

Note that, although the set packer 20 separates the upper annulus 22 from the lower annulus 24, in the step of the method as depicted in FIG. 3, the upper annulus and lower annulus are not yet fully isolated from each other. Instead, another flow passage 38 in the service string 18 provides for fluid communication between the upper annulus 22 and the lower annulus 24.

In FIG. 3, it may be seen that a lower port 40 permits communication between the flow passage 38 and an interior of the completion assembly 16. Openings 42 formed through the completion assembly 16 permit communication between the interior of the completion assembly and the lower annulus 24.

An annular seal 44 is sealingly received in a seal bore 46. The seal bore 46 is located within the packer 20 in this example, but in other examples, the seal bore could be otherwise located (e.g., above or below the packer).

In the step as depicted in FIG. 3, the seal 44 isolates the port 40 from another port 48 that provides communication between another flow passage 50 and an exterior of the service string 18. At this stage of the method, no flow is permitted through the port 48, because one or more additional annular seals 52 on an opposite longitudinal side of the port 48 are also sealingly received in the seal bore 46.

An upper end of the flow passage 38 is in communication with the upper annulus 22 via an upper port 54. Although not clearly visible in FIG. 3, relatively small annular spaces between the setting tool 36 and the packer 20 provide for communication between the port 54 and the upper annulus 22.

Thus, it will be appreciated that the flow passage 38 and ports 40, 54 effectively bypass the seal bore 46 (which is engaged by the annular seals 44, 52 carried on the service string 18) and allow for hydrostatic pressure in the upper annulus 22 to be communicated to the lower annulus 24. This enhances wellbore 12 stability, in part by preventing pressure in the lower annulus 24 from decreasing (e.g., toward pressure in the formation 14) when the packer 20 is set.

Figure 4:
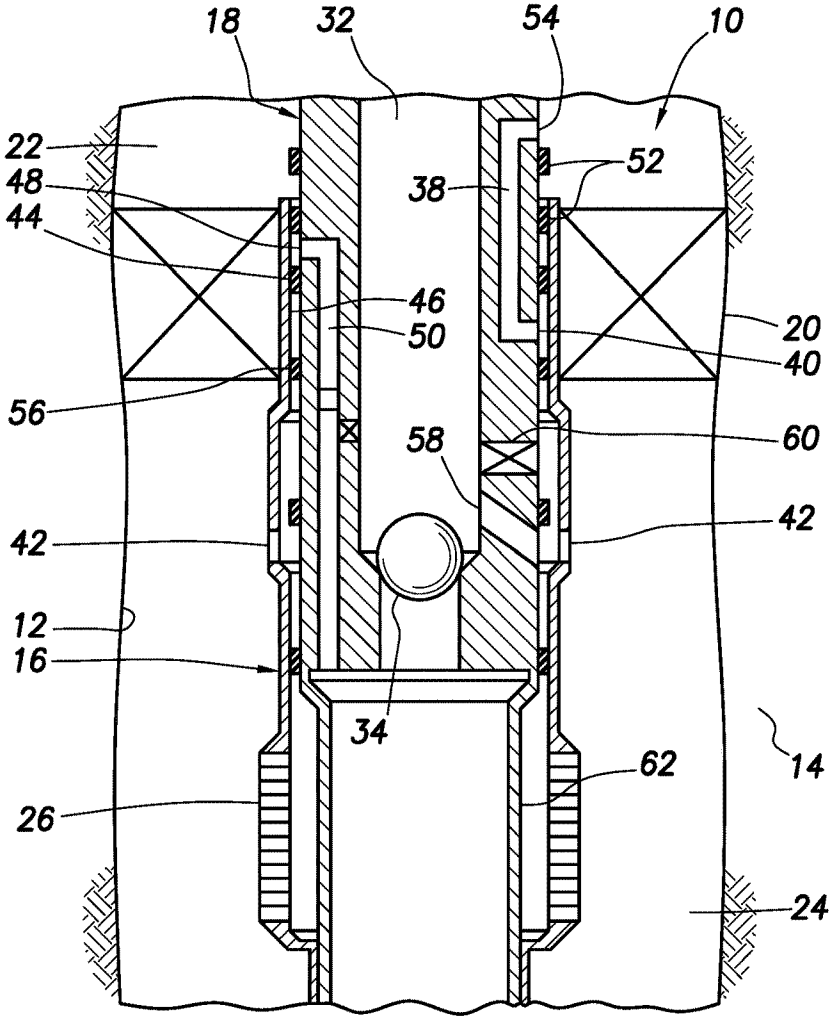

As depicted in FIG. 4, the service string 18 has been raised relative to the completion string 16, which is now secured to the wellbore 12 due to previous setting of the packer 20. In this position, another annular seal 56 carried on the service string 18 is now sealingly engaged in the seal bore 46, thereby isolating the flow passage 38 from the lower annulus 24.

However, the flow passage 32 is now in communication with the lower annulus 24 via the openings 42 and one or more ports 58 in the service string 18. Thus, hydrostatic pressure continues to be communicated to the lower annulus 24.

The lower annulus 24 is isolated from the upper annulus 22 by the packer 20. The flow passage 38 is not in communication with the lower annulus 24 due to the annular seal 56 in the seal bore 46. The flow passage 50 may be in communication with the lower annulus 24, but no flow is permitted through the port 48 due to the annular seal 52 in the seal bore 46. Thus, the lower annulus 24 is isolated completely from the upper annulus 22.

In the FIG. 4 position of the service string 18, the packer 20 can be tested by applying increased pressure to the upper annulus 22 (for example, using surface pumps). If there is any leakage from the upper annulus 22 to the lower annulus 24, this leakage will be transmitted via the openings 42 and ports 58 to surface via the flow passage 32, so it will be apparent to operators at surface and remedial actions can be taken.

Figure 5:
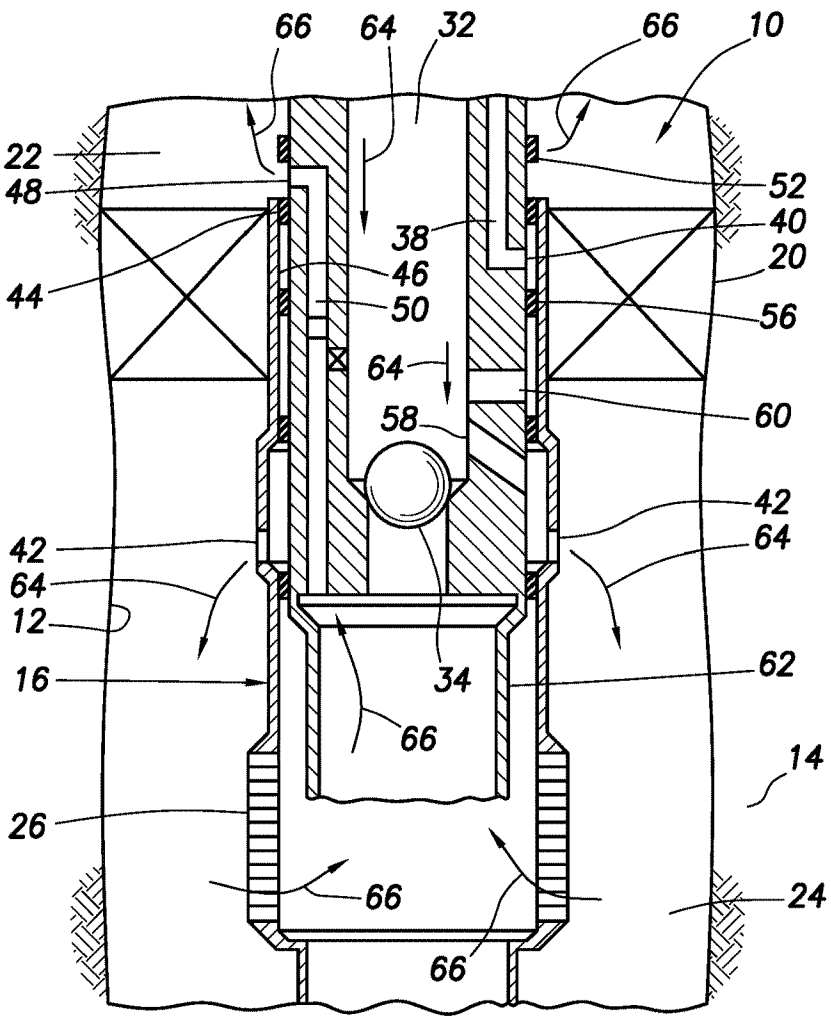

As depicted in FIG. 5, a reversing valve 60 has been opened by raising the service string 18 relative to the completion assembly 16, so that the annular seal 56 is above the seal bore 46, and then applying pressure to the upper annulus 22 to open the reversing valve. The service string 18 is then lowered to its FIG. 5 position (which is raised somewhat relative to its FIG. 4 position).

Thus, in this example, the reversing valve 60 is an annular pressure-operated sliding sleeve valve of the type well known to those skilled in the art, and so operation and construction of the reversing valve is not described or illustrated in more detail by this disclosure. However, it should be clearly understood that the scope of this disclosure is not limited to use of any particular type of reversing valve, or to any particular technique for operating a reversing valve.

The raising of the service string 18 relative to the completion assembly 16 can facilitate operations other than opening of the reversing valve 60. In this example, the raising of the service string 18 can function to prepare an isolation valve (not shown) connected in or below a washpipe 62 of the service string for later closing.

The isolation valve can be of the type well known to those skilled in the art, and which can (when closed) prevent flow from the flow passage 32 into an interior of the well screen 26. However, the scope of this disclosure is not limited to use of any particular type of isolation valve, or to any particular technique for operating an isolation valve.

As described more fully below, raising of the service string 18 can also, or alternatively, prepare a positioning tool 80 for subsequent securement of the service string relative to the completion assembly 16. In this example, the positioning tool 80, when actuated, enables a weight of the service string 18 to be set down on an internal shoulder or other profile in the completion assembly 16, so that a preselected position of the service string relative to the completion assembly can be conveniently and reliably achieved and maintained.

In the FIG. 5 position, the flow passage 32 is in communication with the lower annulus 24 via the openings 42 and ports 58. In addition, the flow passage 50 is in communication with the upper annulus 22 via the port 48. The flow passage 50 is also in communication with an interior of the well screen 26 via the washpipe 62.

The positioning tool 80 is actuated so that extendable landing dogs thereof can engage an internal profile in the completion assembly 16. All or a portion of the weight of the service string 18 can then be set down on the internal profile.

A gravel slurry 64 (a mixture of the gravel 28 and one or more fluids 66) can now be flowed from surface through the flow passage 32 of the service string 18, and outward into the lower annulus 24 via the openings 42 and ports 58. The fluids 66 can flow inward through the well screen 26, into the washpipe 62, and to the upper annulus 22 via the flow passage 50 for return to surface. In this manner, the gravel 28 is deposited into the lower annulus 24 (see FIGS. 6 & 7).

During pumping of the gravel slurry 64, the service string 18 is prevented from displacing relative to the completion assembly 16 by the engagement between the positioning tool 80 and the internal profile in the completion assembly.

Figure 6:
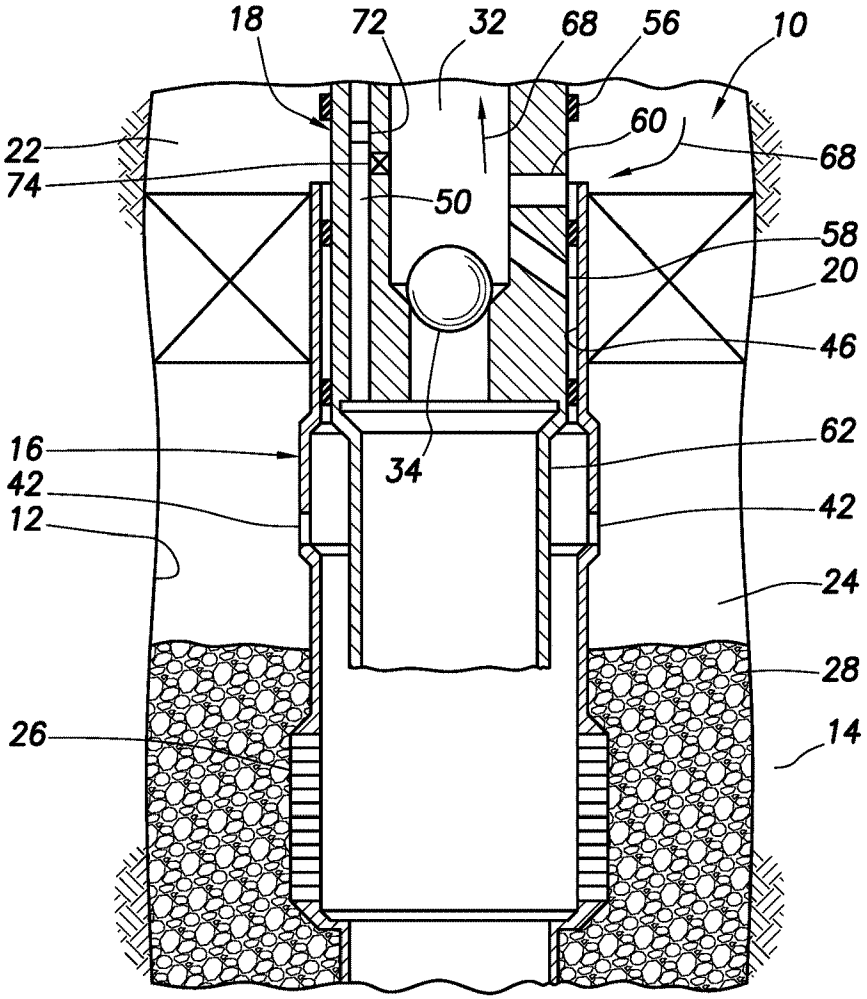

As depicted in FIG. 6, the service string 18 has been raised further relative to the completion assembly 16 after the gravel slurry 64 pumping operation is concluded. The annular seal 56 is now out of the seal bore 46, thereby exposing the reversing valve 60 again to the upper annulus 22.

A clean fluid 68 can now be circulated from surface via the upper annulus 22 and inward through the open reversing valve 60, and then back to surface via the flow passage 32. This reverse circulating flow can be used to remove any gravel 28 remaining in the flow passage 32 after the gravel slurry 64 pumping operation. During pumping of the fluid 68, the service string 18 is prevented from displacing relative to the completion assembly 16 by engagement between the positioning tool 80 and another internal profile in the completion assembly.

After reverse circulating, the service string 18 can be conveniently retrieved to surface and a production tubing string (not shown) can be installed.

Flow through the openings 42 is prevented when the service string 18 is withdrawn from the completion assembly 16 (e.g., by shifting a sleeve of the type known to those skilled in the art as a closing sleeve). A lower end of the production tubing string can be equipped with annular seals and stabbed into the seal bore 46, after which fluids can be produced from the formation 14 through the gravel 28, then into the well screen 26 and to surface via the production tubing string.

Figure 7:
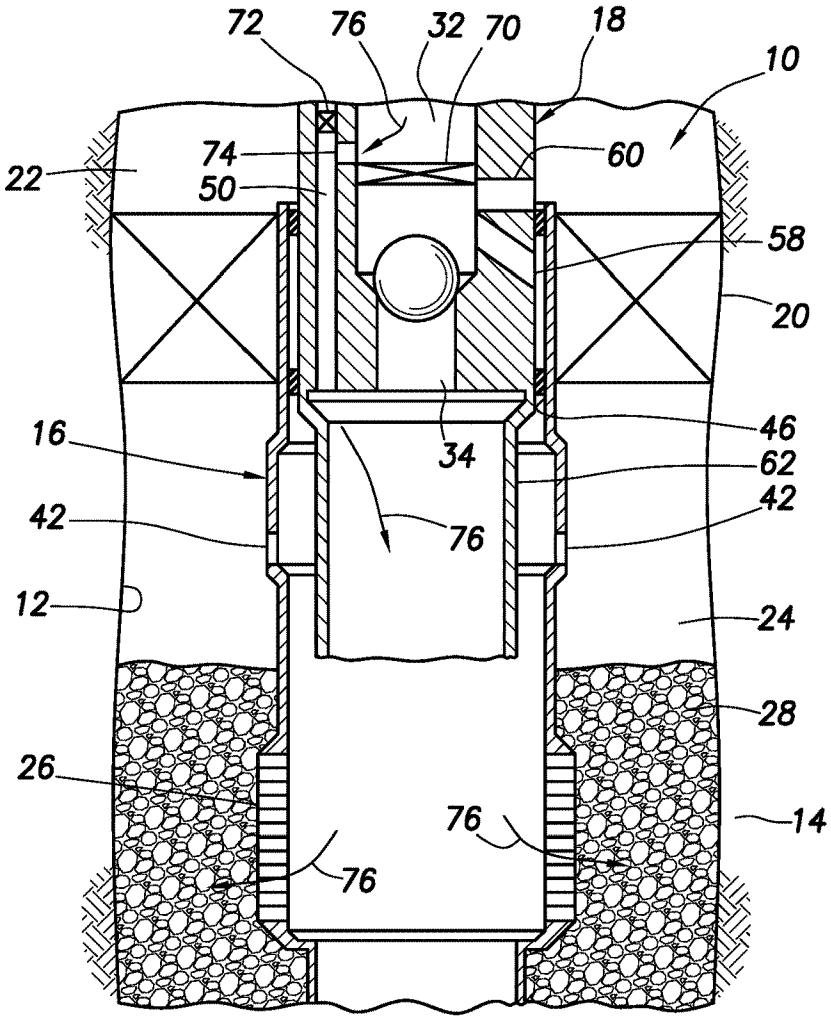

An optional treatment step is depicted in FIG. 7. This treatment step can be performed after the reverse circulating step of FIG. 6, and before retrieval of the service string 18.

As depicted in FIG. 7, another ball, dart or other plug 70 is installed in the flow passage 32, and then increased pressure is applied to the flow passage. This increased pressure causes a lower portion of the flow passage 50 to be isolated from an upper portion of the flow passage (e.g., by closing a valve 72), and also causes the lower portion of the flow passage 50 to be placed in communication with the flow passage 32 above the plug 70 (e.g., by opening a valve 74). Suitable valve arrangements for use as the valves 72, 74 are described in U.S. Pat. Nos. 6,702,020 and 6,725,929, although other valve arrangements may be used in keeping with the principles of this disclosure.

The lower portion of the flow passage 50 is, thus, now isolated from the upper annulus 22. However, the lower portion of the flow passage 50 now provides for communication between the flow passage 32 and the interior of the well screen 26 via the washpipe 62. Note, also, that the lower annulus 24 is isolated from the upper annulus 22.

A treatment fluid 76 can now be flowed from surface via the flow passages 32, 50 and washpipe 62 to the interior of the well screen 26, and thence outward through the well screen into the gravel 28. If desired, the treatment fluid 76 can further be flowed into the formation 14. During pumping of the treatment fluid 76, the service string 18 is prevented from displacing relative to the completion assembly 16 by engagement between the positioning tool 80 and another internal profile in the completion assembly.

The treatment fluid 76 could be any type of fluid suitable for treating the well screen 26, gravel 28, wellbore 12 and/or formation 14. For example, the treatment fluid 76 could comprise an acid for dissolving a mud cake (not shown) on a wall of the wellbore 12, or for dissolving contaminants deposited on the well screen 26 or in the gravel 28. Acid may be flowed into the formation 14 for increasing its permeability. Conformance agents may be flowed into the formation 14 for modifying its wettability or other characteristics. Breakers may be flowed into the formation 14 for breaking down gels used in a previous fracturing operation. Thus, it will be appreciated that the scope of this disclosure is not limited to use of any particular treatment fluid, or to any particular purpose for flowing treatment fluid into the completion assembly 16.

Figure 8:
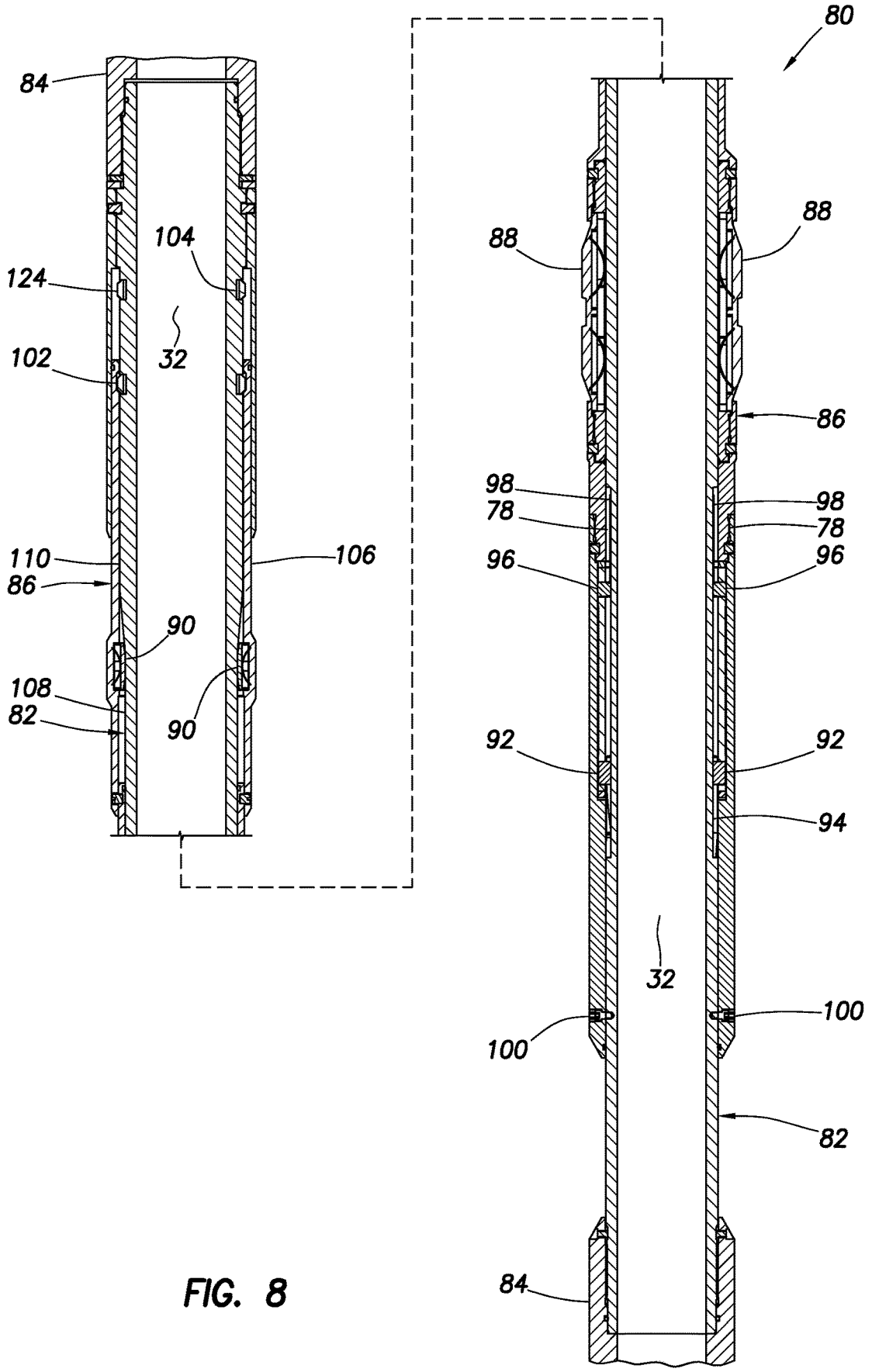
FIG. 8 is a representative enlarged scale cross-sectional view of a positioning tool which may be used in the system and method of FIGS. 1-7.

Referring additionally now to FIG. 8, a cross-sectional view of an example of the positioning tool 80 is representatively illustrated. The positioning tool 80 is depicted in FIG. 8 as it is initially installed in a well. The positioning tool 80 may be used in the system 10 and method of FIGS. 1-7, or it may be used in other systems and methods.

In the FIG. 8 example, the positioning tool 80 includes a generally tubular inner mandrel 82 with connectors 84 at each end. The connectors 84 may be provided with appropriate threads, seals, etc., for sealingly connecting the positioning tool 80 in a tubular string (such as the washpipe 62 in the FIGS. 1-7 example). When connected as part of the washpipe 62, the flow passage 32 extends longitudinally through the mandrel 82.

An engagement device 86 is reciprocably disposed on the mandrel 82. The engagement device 86 is used to engage one or more internal profiles in an outer tubular string (such as the completion assembly 16), and to secure the positioning tool 80 relative to the outer tubular string.

As depicted in FIG. 8, the engagement device 86 includes a series of circumferentially distributed and outwardly biased engagement members or keys 88, and a series of circumferentially distributed and inwardly biased landing dogs 90. Pins or other followers 92 extend inwardly from the engagement device 86 into engagement with a recessed profile 94 formed externally on the mandrel 82.

The profile 94 is in this example of the type known to those skilled in the art as a "ratchet" or "J-slot" profile. However, other types of profiles may be used in other examples.

In addition, it is not necessary for the profile 94 to be formed on the mandrel 82, and for the followers 92 to be carried on the engagement device 86. In other examples, these positions could be reversed. Thus, the scope of this disclosure is not limited at all to any of the details of the engagement device 86, mandrel 82 or any other components of the positioning tool 80.

Additional pins or followers 96 can engage longitudinal slots 98 or lugs 78 formed externally on the mandrel 82. These followers 96, slots 98 and lugs 78 function to control an extent of downward displacement of the mandrel 82 relative to the engagement device 86, as described more fully below.

In other examples, the followers 92, 96 could be rigidly secured to the mandrel 82, and the profile 94 and lugs 78 could be carried on the engagement device 86. In further examples, the profile 94 could be in the form of a raised track, instead of a recessed slot, and the follower 92 could be a "female" rather than a "male" member. Thus, it will be appreciated that the scope of this disclosure is not limited to any particular details of the mandrel 82 or the engagement device 86, or any of their elements or components.

The engagement device 86 is initially releasably secured against displacement relative to the mandrel 82 by shear screws 100. In addition, a snap ring 102 carried on the mandrel 82 engages an annular recess 104 in a generally tubular cage 106 that carries the landing dogs 90.

Note that, in the FIG. 8 configuration, the landing dogs 90 are biased inwardly into contact with a reduced outer diameter section 108 of the mandrel 82. In this manner, the landing dogs 90 are retracted inward and will not engage any shoulders or other profiles in the outer tubular string. However, if the mandrel 82 is displaced downward relative to the engagement device 86, so that the landing dogs 90 are radially outwardly supported by an enlarged diameter section 110 of the mandrel, then the landing dogs will be extended outward for engagement with a profile in the outer tubular string, as described more fully below.

Figure 9:
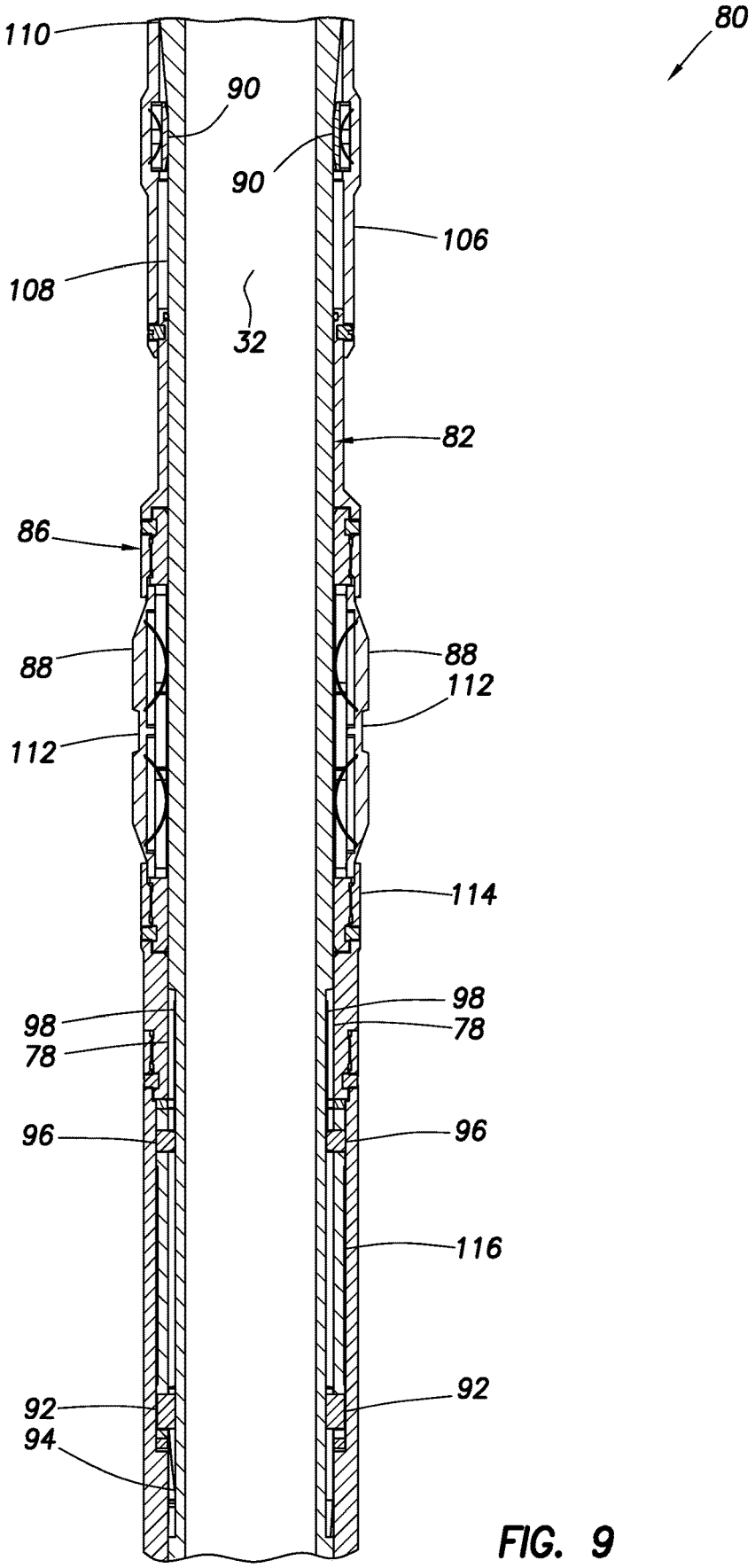
FIG. 9 is a representative further enlarged scale cross-sectional view of a section of the positioning tool in a run-in configuration.

Referring additionally now to FIG. 9, a further enlarged scale cross-sectional view of the positioning tool 80 is representatively illustrated. The positioning tool 80 remains in its initially installed configuration as depicted in FIG. 9. In this view, certain details of the positioning tool 80 example are more clearly visible.

The keys 88 are radially outwardly biased and have external profiles 112 formed thereon. As the positioning tool 80 is displaced through the outer tubular string, the profiles 112 are able to engage one or more complementarily shaped internal profiles in the outer tubular string.

After such engagement, the keys 88 can be disengaged from the internal profile by applying a sufficient longitudinal force to the positioning tool 80 to cause the keys to radially inwardly retract into a cage 114 that carries the keys. Preferably, the force needed to retract the keys 88 out of engagement with the internal profile is greater than a force sufficient to shear the shear screws 100 and release the snap ring 102 from the recess 104 (see FIG. 8).

Note that the followers 92, 96 are secured to, and extend radially inwardly from a sleeve 116 rotatably mounted in the engagement device 86. In this manner, the followers 92, 96 and sleeve 116 are permitted to rotate relative to the remainder of the engagement device 86, in response to longitudinal displacement of the mandrel 82 relative to the engagement device, and engagement between the followers 92 and the profile 94 on the mandrel.

In the FIG. 9 configuration, the followers 96 abut lower ends of the lugs 78, thereby preventing downward displacement of the mandrel 82 relative to the engagement device 86. In this manner, the positioning tool 80 can be displaced downwardly through any number of internal profiles in the outer tubular string, without causing the landing dogs 90 to be extended outward by relative displacement between the mandrel 82 and the engagement device 86.

Figure 10:
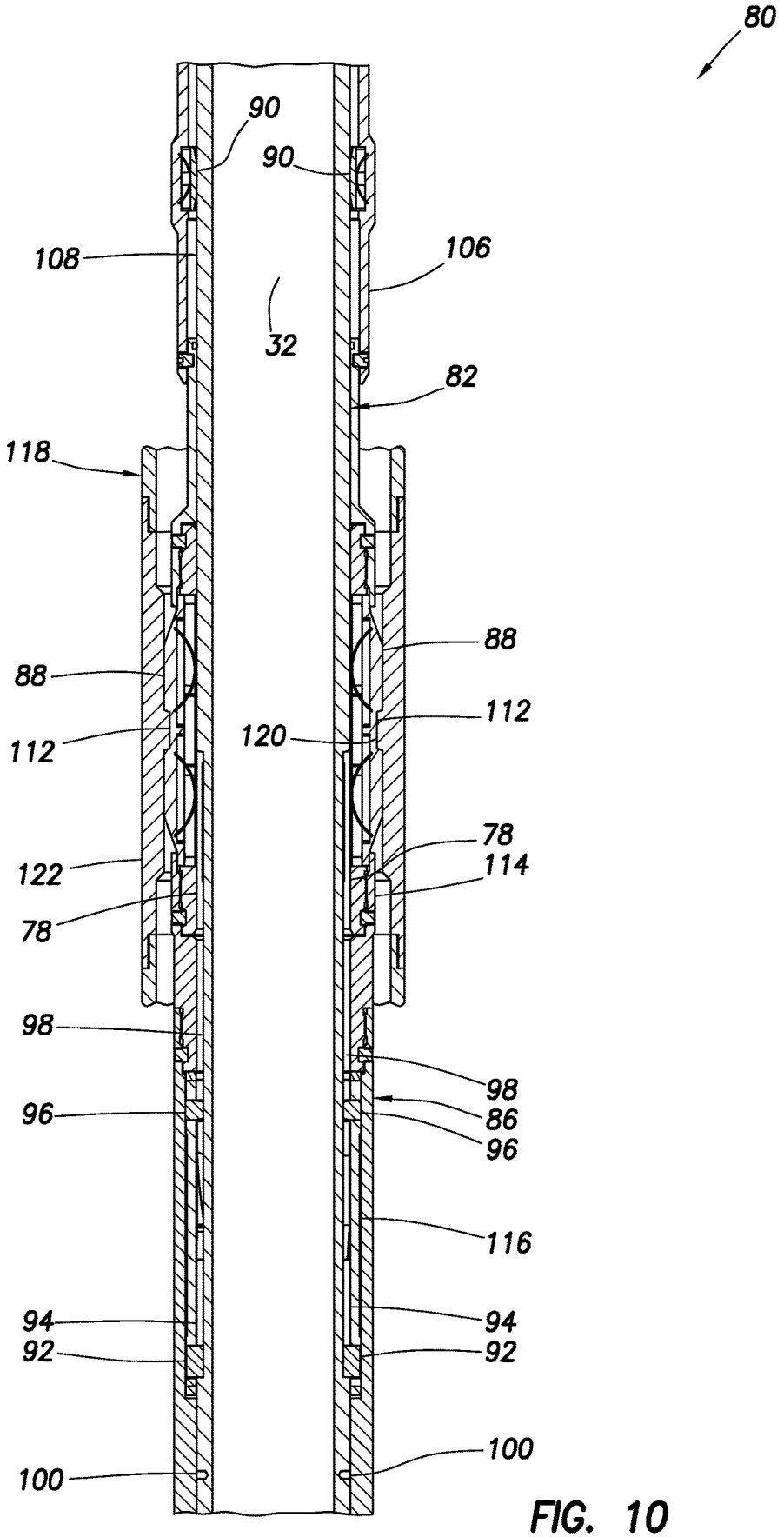
FIG. 10 is a representative cross-sectional view of the positioning tool section after engagement with an internal profile in a completion assembly.

Referring additionally now to FIG. 10, the positioning tool 80 is representatively illustrated as being installed downhole in an outer tubular string 118. In the FIGS. 1-7 example described above, the outer tubular string 118 can correspond to the washpipe 62. However, in other examples, different types of outer tubular strings may be used with the positioning tool 80.

In the FIG. 10 example, the tubular string 118 has an internal profile 120 formed therein, such as, in a coupling 122 connected as part of the tubular string. The internal profile 120 is complementarily shaped relative to the external profiles 112 on the keys 88, so that, as the positioning tool 80 is displaced through the tubular string 118, the keys can engage the internal profile and resist displacement of the engagement device 86 relative to the tubular string.

As depicted in FIG. 10, the positioning tool 80 has been displaced upwardly through the tubular string 118, and the keys 88 have engaged the internal profile 120. The mandrel 82 has continued to displace upward, and the engagement between the keys 88 and the profile 120 has resisted upward displacement of the engagement device 86 with sufficient force to shear the shear screws 100 and release the snap ring 102 from the annular recess 104. In this manner, the mandrel 82 is displaced upward relative to the engagement device 86.

The followers 92 are now positioned in a lower portion of the profile 94 on the mandrel 82. This rotates the followers 92, 96 and sleeve 116 relative to the remainder of the engagement device 86 and the lugs 78, prevents further upward displacement of the mandrel 82 relative to the engagement device 86 and allows upward force applied to the mandrel to be transmitted to the engagement device. Such upward force can be used to release the keys 88 from their engagement with the internal profile 120, if desired.

However, it is not necessary for the keys 88 to be released from engagement with the internal profile 120 using an upward force applied to the mandrel 82 if, for example, it is desired for the landing dogs 90 to be extended and displaced downwardly into engagement with the same internal profile 120. In that case, the mandrel 82 can be displaced downwardly relative to the engagement device 86, after having been displaced upwardly relative to the engagement device to the configuration depicted in FIG. 10.

Note that, with the mandrel 82 having been displaced upwardly relative to the engagement device 86 as depicted in FIG. 10, the landing dogs 90 remain in their radially retracted positions, outwardly supported by the radially reduced section 108 of the mandrel. To extend the landing dogs 90 radially outward, the mandrel 82 is displaced downwardly relative to the engagement device 86 (while the keys 88 are engaged with the same or another internal profile 120), so that the landing dogs are outwardly supported by the radially enlarged section 110 of the mandrel.

Figure 11:
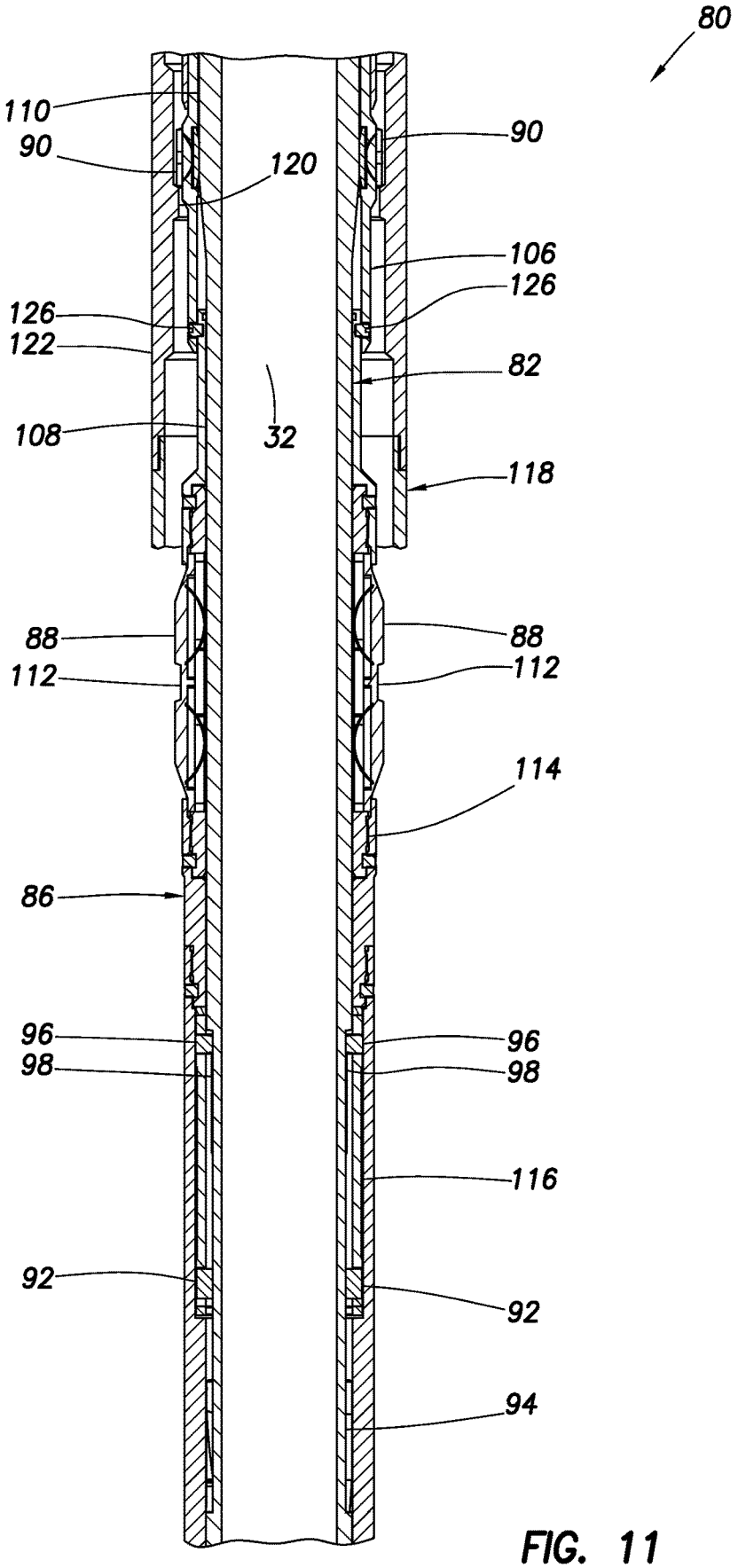
FIG. 11 is a representative cross-sectional view of the positioning tool section with landing dogs thereof engaged with an internal profile in the completion assembly.

Referring additionally now to FIG. 11, the positioning tool 80 is representatively illustrated after the mandrel 82 has been displaced downwardly relative to the engagement device 86, thereby radially outwardly extending the landing dogs 90. The landing dogs 90 are now outwardly supported by the radially enlarged section 110 of the mandrel 82.

As described above, this downward displacement of the mandrel 82 relative to the engagement device 86 is performed while the keys 88 are engaged with an internal profile 120 in the tubular string 118. Although not visible in FIG. 11, this downward displacement of the mandrel 82 causes another snap ring 124 (see FIG. 8) carried on the mandrel to engage the annular recess 104, thereby releasably retaining the engagement device 86 against inadvertent displacement relative to the mandrel.

As depicted in FIG. 11, the extended landing dogs 90 have engaged an internal profile 120 in the tubular string 118. This internal profile 120 may be the same internal profile as previously engaged by the keys 88, or it may be another internal profile.

The followers 96 are now at an upper end of the slots 98, thereby preventing further downward displacement of the mandrel 82 relative to the engagement device 86. A substantial downward force (e.g., some or all of a weight of the service string 18 in the example of FIGS. 1-7) can now be applied to the mandrel 82, with the substantial force being supported by the engagement between the landing dogs 90 and the internal profile 120. In this example, the substantial force is much greater than could be supported by the previous engagement between the keys 88 and an internal profile 120.

When used in the system 10 and method of FIGS. 1-7, the positioning tool 80 may be in the configuration of FIG. 11, for example, during the gravel slurry 64 flowing step of FIG.

5, the reverse circulating step of FIG. 6, and/or the treatment step of FIG. 7. However, the scope of this disclosure is not limited to extending the landing dogs 90 and engaging them with an internal profile 120 during any particular step(s) of any particular well operation.

It will be appreciated that, since the service string 18 is in different positions relative to the completion assembly 16 for the FIGS. 5-7 steps, the positioning tool 80 will be displaced with the service string between these steps. To facilitate repositioning of the tool 80 in the completion assembly 16, the landing dogs 90 can be retracted by upwardly displacing the mandrel 82, so that the keys 88 again engage an internal profile 120 (thereby ceasing upward displacement of the engagement device 86), and continuing to upwardly displace the mandrel relative to the engagement device.

The landing dogs 90 will no longer be radially outwardly supported by the radially enlarged section 110 of the mandrel 82, but will instead be in their retracted positions as depicted in FIG. 9. In this configuration, the positioning tool 80 can again be displaced upwardly or downwardly through the tubular string 118, without causing the landing dogs 90 to be extended outward.

The landing dogs 90 will only be extended outward, in this example, every other time the positioning tool 80 is displaced upwardly so that the engagement device 86 engages at least one internal profile 120, and is then displaced downwardly so that the engagement device engages an internal profile. However, the landing dogs 90 are retracted each time the positioning tool 80 is displaced upward with the engagement device 86 engaged with an internal profile 120.

If it should happen that the landing dogs 90 fail to retract in response to upward displacement of the mandrel 82 relative to the engagement device 86, the extended landing dogs may engage an internal profile 120 or other restriction during upward displacement of the positioning tool 80 relative to the tubular string 118 (such as, during retrieval of the service string 18). In that case, a sufficient upward force can be applied to the positioning tool 80 to cause shear screws 126 to shear, thereby allowing the mandrel 82 to displace upward relative to the landing dogs 90, so that the landing dogs are no longer outwardly supported by the radially enlarged section 110 of the mandrel and will retract.

Figure 12:
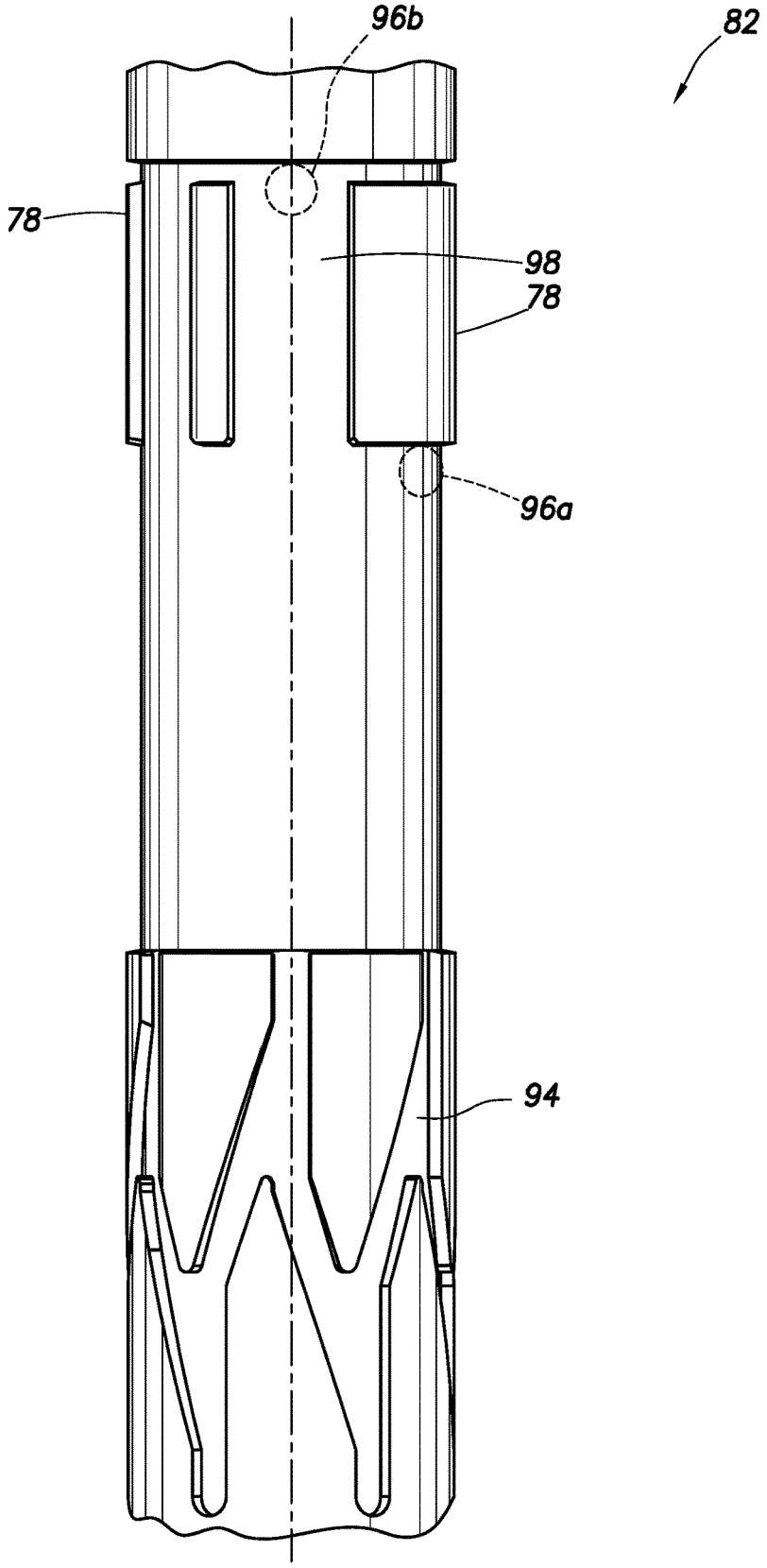
FIG. 12 is a representative further enlarged scale side view of a section of a mandrel of the positioning tool.

Referring additionally now to FIG. 12, a section of the mandrel 82 is representatively illustrated, apart from the remainder of the positioning tool 80. This section of the mandrel 82 includes the lugs 78, external profile 94 and slots 98.

As described above, the followers 92 are engaged with the profile 94. It will be appreciated that the shape of the profile 94 example of FIG. 12 will cause relative rotation between the mandrel 82 and the followers 92 (and the followers 96 and sleeve 116), in response to longitudinal reciprocation of the mandrel relative to the engagement device 86. Thus, upward and downward displacement of the positioning tool 80 through the tubular string 118, so that the engagement device 86 engages an internal profile 120 during such upward and downward displacements, will result in relative rotation between the mandrel 82 and the followers 96.

When the followers 96 are rotationally aligned with the lugs 78 (as indicated by position 96*a* in FIG. 12), downward displacement of the mandrel 82 relative to the engagement device 86 is limited, so that the landing dogs 90 will not be extended. This corresponds to the configuration of FIG. 9, in which the positioning tool 80 can be downwardly displaced through the tubular string 118, with the keys 88 engaging any number of internal profiles 120, without causing any significant relative displacement between the mandrel 82 and the engagement device 86.

Relative rotation between the followers 96 and the mandrel 82 (caused by reciprocation of the mandrel relative to the engagement device 86, as described above and depicted from FIG. 9 to FIG. 10 and from FIG. 10 to FIG. 11) will eventually result in the followers being rotationally aligned with the slots 98. When this occurs, substantial downward displacement of the mandrel 82 relative to the engagement device 86 (with the keys 88 engaged with an internal profile 120) will be permitted, since the followers 96 will be received in the slots 98 (e.g., to position 96*b* as depicted in FIG. 12). This corresponds to the configuration of FIG. 11, in which the landing dogs 90 are extended in response to the downward displacement of the mandrel 82 relative to the engagement device 86.

Note that any pattern of reciprocating displacements may be used to cause extension and retraction of the landing dogs 90. For example, the profile 94 and lugs 78 can be configured to require three or more sets of alternating relative displacements between the mandrel 82 and the engagement device 86 for each time the landing dogs 90 are extended. Thus, the scope of this disclosure is not limited to any particular configuration of the profile 94 and lugs 78, or to any particular pattern or sequence of reciprocal displacements corresponding to extension and retraction of the landing dogs 90.

Although the positioning tool 80 is described above as being used to secure a tubular string (such as the service string 18) by allowing weight or another longitudinally downward force to be applied from the landing dogs 90 to an internal profile 120, in other examples a longitudinally upward force may be applied (e.g., by pulling tension on the service string from surface). For example, the positioning tool 80 could be inverted from its FIGS. 8-12 orientation.

It may now be fully appreciated that the above disclosure provides significant advancements to the arts of constructing and utilizing equipment for well operations. In examples described above, the positioning tool 80 provides for enhanced convenience and reliability in securing a tubular string (such as the service string 18) relative to another outer tubular string (such as the completion assembly 16).

The above disclosure provides to the art a positioning tool 80 for use in a well. In one example, the positioning tool 80 can include a generally tubular mandrel 82 and an engagement device 86 reciprocably disposed on the mandrel. The engagement device 86 can include at least one engagement member (such as keys 88) and at least one landing dog 90. The mandrel 82 displaces relative to the engagement device 86 in response to engagement between the engagement member 88 and at least one internal profile 120 in an outer tubular string 118. The landing dog 90 extends outward in response to displacement of the mandrel 82 in a first longitudinal direction relative to the engagement device 86.

The engagement member 88 may be biased outward relative to the mandrel 82 and the landing dog 90 may be biased inward relative to the mandrel. The landing dog 90 may be outwardly supported by a radially reduced section 108 of the mandrel 82 in a retracted position of the landing dog, and the landing dog 90 may be outwardly supported by a radially enlarged section 110 of the mandrel in an extended position of the landing dog.

The landing dog 90 may extend outward in response to displacement of the mandrel 82 in a second longitudinal direction relative to the engagement device 86. The landing dog 90 may retract inward in response to every displacement of the mandrel 82 in a second longitudinal direction relative to the engagement device 86, and the landing dog 90 may extend outward in response to less than every displacement of the mandrel 82 in the first longitudinal direction relative to the engagement device 86.

An extent of longitudinal displacement of the mandrel 82 in the first direction relative to the engagement device 86 may be controlled by engagement between a follower 96 and a slot 98. One of the follower 96 and the slot 98 rotates about the mandrel 82 in response to reciprocation of the mandrel relative to the engagement device 86.

A system 10 for use in a subterranean well is also provided to the art by the above disclosure. In one example, the system 10 can include a tubular string 118 and a positioning tool 80 reciprocably disposed in the tubular string. The positioning tool 80 can include a landing dog 90 that extends outward from a retracted position to engage one or more internal profiles 120 of the tubular string 118, in response to a pattern of reciprocation of the positioning tool 80 in the tubular string.

The landing dog 90 may retract from an extended position to the retracted position in response to displacement of the positioning tool 80 in a first longitudinal direction through the one or more internal profiles 120. The landing dog 90 may extend from the retracted position to the extended position in response to displacement of the positioning tool 80 in a second longitudinal direction through at least one of the internal profiles 120.

The positioning tool 80 may also include an engagement member 88. Displacement of the landing dog 90 relative to the tubular string 118 may cease in response to engagement between the engagement member 88 and at least one of the internal profiles 120.

The positioning tool 80 can include a mandrel 82, with the mandrel being longitudinally displaceable relative to the landing dog 90 as the positioning tool displaces through the one or more internal profiles 120. The landing dog 90 may be outwardly supported by a radially reduced section 108 of the mandrel 82 in response to displacement of the positioning tool 80 through the one or more internal profiles 120 in a first longitudinal direction. The landing dog 90 may be outwardly supported by a radially enlarged section 110 of the mandrel 82 in response to displacement of the positioning tool 80 through the one or more internal profiles 120 in a second longitudinal direction.

A method of gravel packing a well is also described above. In one example, the method can comprise: disposing a service string 18 in a completion assembly 16 in the well, the service string including a positioning tool 80 having an engagement member 88 and an extendable landing dog 90, and the completion assembly 16 having one or more internal profiles 120; displacing the positioning tool 80 in a first longitudinal direction relative to the completion assembly 16, thereby engaging the engagement member 88 with the one or more internal profiles 120; and displacing the positioning tool 80 in a second longitudinal direction relative to the completion assembly 16, thereby engaging the engagement member 88 with the one or more internal profiles 120 and outwardly extending the landing dog 90.

The method can include engaging the landing dog 90 with one of the internal profiles 120 by further displacing the positioning tool 80 in the second longitudinal direction after the landing dog is outwardly extended. The landing dog 90 may retract in response to displacing the positioning tool 80 in the first longitudinal direction with the engagement member 88 engaged with the one or more internal profiles 120. The landing dog 90 may extend less than every time the positioning tool 80 is displaced in the second longitudinal direction with the engagement member 88 engaged with the one or more internal profiles 120.

The step of displacing the positioning tool 80 in the first longitudinal direction may include displacing a mandrel 82 of the positioning tool relative to the landing dog 90 while the engagement member 88 is engaged with the one or more internal profiles 120. The step of displacing the positioning tool 80 in the second longitudinal direction can include displacing the mandrel 82 relative to the landing dog 90 while the engagement member 88 is engaged with the one or more internal profiles 120, thereby outwardly supporting the landing dog 90 with a radially enlarged section 110 of the mandrel 82.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A positioning tool for use in a well, the positioning tool comprising:

a generally tubular mandrel; and an engagement device reciprocably disposed on the mandrel, the engagement device including at least one engagement member which is configured to be biased outward relative to the mandrel at all times while the positioning tool is in the well and the engagement device further including at least one landing dog, wherein the mandrel displaces relative to the engagement device in response to at least one external profile formed on the engagement member meshing with at least one complementarily shaped internal profile in an outer tubular string, and wherein an extent of displacement of the mandrel in a first longitudinal direction relative to the engagement device is controlled by engagement between a follower and a slot.

2. The positioning tool of claim 1, wherein the landing dog is biased inward relative to the mandrel.

3. The positioning tool of claim 1, wherein the landing dog is outwardly supported by a radially reduced section of the mandrel in a retracted position of the landing dog, and wherein the landing dog is outwardly supported by a radially enlarged section of the mandrel in an extended position of the landing dog.

4. The positioning tool of claim 1, wherein the landing dog extends outward in response to displacement of the mandrel in the first longitudinal direction relative to the engagement device.

5. The positioning tool of claim 1, wherein the landing dog retracts inward in response to every displacement of the mandrel in a second longitudinal direction relative to the engagement device, and wherein the landing dog extends outward in response to less than every displacement of the mandrel in the first longitudinal direction relative to the engagement device.

6. The positioning tool of claim 1, wherein one of the follower and the slot rotates about the mandrel in response to reciprocation of the mandrel relative to the engagement device.

7. A system for use in a subterranean well, the system comprising:

a tubular string; and a service string reciprocably disposed in the tubular string, the service string including a positioning tool, wherein the positioning tool includes an engagement member which is radially outwardly biased at all times while the positioning tool is in the well and which extends into at least one complementarily shaped internal profile in the tubular string in response to longitudinal alignment between the engagement member and the at least one internal profile, and wherein the positioning tool includes a landing dog that, while the engagement member is engaged with the at least one internal profile, extends outward from a retracted position and retracts inward from an extended position, in response to a pattern of reciprocation of the service string in the tubular string.

8. The system of claim 7, wherein displacement of the landing dog relative to the tubular string ceases in response to engagement between the engagement member and the at least one internal profile in the tubular string.

9. The system of claim 8, wherein the positioning tool further includes a mandrel which is coupled to the service string, the mandrel being longitudinally displaceable relative to the landing dog during the engagement between the engagement member and the at least one internal profile.

10. The system of claim 9, wherein the landing dog is outwardly supported by a radially reduced section of the mandrel in response to displacement of the service string in a first longitudinal direction during the engagement between the engagement member and the at least one internal profile.

11. The system of claim 10, wherein the landing dog retracts from the extended position to the retracted position when the landing dog is outwardly supported by the radially reduced section of the mandrel.

12. The system of claim 9, wherein the landing dog is outwardly supported by a radially enlarged section of the mandrel in response to displacement of the service string in a second longitudinal direction during the engagement between the engagement member and the at least one internal profile.

13. The system of claim 12, wherein the landing dog extends from the retracted position to the extended position when the landing dog is outwardly supported by the radially enlarged section of the mandrel.

14. A method for use in a subterranean well, the method comprising:

disposing a service string in a completion assembly in the well, the service string including a positioning tool having an engagement member and an extendable landing dog, and the completion assembly having one or more internal profiles;

displacing the service string in a first longitudinal direction relative to the completion assembly, thereby engaging the engagement member with the one or more internal profiles; and displacing the service string in a second longitudinal direction opposite the first longitudinal direction, thereby outwardly extending the extendable landing dog.

15. The method of claim 14, further comprising engaging the landing dog with one of the internal profiles by further displacing the service string in the second longitudinal direction after the landing dog is outwardly extended.

16. The method of claim 14, wherein the landing dog retracts in response to displacing the service string in the first longitudinal direction with the engagement member engaged with the one or more internal profiles.

17. The method of claim 14, wherein the landing dog extends less than every time the service string is displaced in the second longitudinal direction with the engagement member engaged with the one or more internal profiles.

18. The method of claim 14, wherein displacing the service string in the first longitudinal direction further comprises displacing a mandrel of the positioning tool relative to the landing dog while the engagement member is engaged with the one or more internal profiles.

19. The method of claim 18, wherein displacing the service string in the second longitudinal direction further comprises displacing the mandrel relative to the landing dog while the engagement member is engaged with the one or more internal profiles, thereby outwardly supporting the landing dog with a radially enlarged section of the mandrel.

* * * * *